US009484666B2

(12) United States Patent
Wu et al.

(10) Patent No.: US 9,484,666 B2
(45) Date of Patent: Nov. 1, 2016

(54) ELECTRICAL CONNECTOR AND ELECTRICAL CONNECTOR ASSEMBLY

(71) Applicant: Tyco Electronics (Shanghai) Co. Ltd., Shanghai (CN)

(72) Inventors: Jianfeng Wu, Shanghai (CN); Jiucai Fan, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 14/637,782

(22) Filed: Mar. 4, 2015

(65) Prior Publication Data

US 2015/0180166 A1 Jun. 25, 2015

Related U.S. Application Data

(63) Continuation of application No. PCT/IB2013/058153, filed on Aug. 30, 2013.

(30) Foreign Application Priority Data

Sep. 4, 2012 (CN) ..... 2012 2 0447084 U

(51) Int. Cl.
*H01R 11/22* (2006.01)
*H01R 13/62* (2006.01)
(Continued)

(52) U.S. Cl.
CPC ..... *H01R 13/62* (2013.01); *H01R 4/20* (2013.01); *H01R 13/04* (2013.01); *H01R 13/055* (2013.01); *H01R 13/11* (2013.01); *H01R 13/113* (2013.01); *H01R 4/185* (2013.01); *H01R 4/188* (2013.01)

(58) Field of Classification Search
CPC .. H01R 13/187; H01R 23/727; H01R 13/20; H01R 13/15; H01R 13/115; H01R 13/113; H01R 9/091; H01R 13/11; H01R 13/112; H01R 4/185
USPC ..... 439/843–857, 877
See application file for complete search history.

(56) References Cited

U.S. PATENT DOCUMENTS 2,785,387 A * 3/1957 Batcheller ..... H01R 13/115 439/290
4,030,804 A * 6/1977 Enomoto ..... H01R 13/115 439/852

(Continued)

FOREIGN PATENT DOCUMENTS

CN 1206509 A 1/1999
WO 2010098157 A1 2/2010

OTHER PUBLICATIONS

PCT Notification of Transmittal of the International Search Report and The Written Opinion of the International Searching Authority, dated Feb. 14, 2014, 1 page.

(Continued)

*Primary Examiner* — Thanh Tam Le
(74) *Attorney, Agent, or Firm* — Barley Snyder

(57) ABSTRACT

An electrical connector assembly is disclosed having a first connector and a second connector. The first connector has a first engagement portion on a first mating end, and at least one first ridge positioned on and protruding outward from an outer surface of the first engagement portion. The second connector has a second engagement portion on a second mating end. The second engagement portion has a first connector receiving chamber having an inner surface, and at least one second ridge positioned on and protruding inward from the inner surface. The at least one second ridge is positioned on, and protrudes inward from, the inner surface, being in electrical contact with the first ridge when the first engagement portion is positioned in the first connector receiving chamber.

15 Claims, 2 Drawing Sheets

(51) Int. Cl.

| | |
|---|---|
| ***H01R 13/11*** | (2006.01) |
| ***H01R 13/05*** | (2006.01) |
| ***H01R 4/20*** | (2006.01) |
| ***H01R 13/04*** | (2006.01) |
| *H01R 4/18* | (2006.01) |

(56) References Cited

U.S. PATENT DOCUMENTS

| | | | | | |
|---|---|---|---|---|---|
| 4,550,972 | A * | 11/1985 | Romak | H01R 13/111 | 439/839 |
| 4,681,393 | A | 7/1987 | Fukishima et al. | | |
| 4,764,133 | A * | 8/1988 | Kaneko | H01R 13/04 | 439/845 |
| 4,992,064 | A * | 2/1991 | Steinhardt | H01R 43/16 | 439/595 |
| 5,281,178 | A * | 1/1994 | Biscorner | H01R 13/052 | 439/845 |
| 5,639,270 | A | 6/1997 | Barbieri et al. | | |
| 5,649,842 | A * | 7/1997 | Ohsumi | H01R 13/04 | 439/852 |
| 5,735,717 | A * | 4/1998 | Nabeshima | H01R 13/113 | 439/851 |
| 5,788,542 | A * | 8/1998 | Miwa | H01R 13/113 | 439/851 |
| 6,364,722 | B1 * | 4/2002 | Yamamoto | H01R 13/113 | 439/850 |
| 6,478,636 | B1 * | 11/2002 | Makita et al. | H01R 13/113 | 439/852 |
| 7,252,564 | B1 * | 8/2007 | Morello | H01R 4/185 | 439/843 |
| 7,544,082 | B1 * | 6/2009 | Halvorsen | H01R 13/5213 | 174/135 |
| 7,713,100 | B2 * | 5/2010 | Hernandez | H01R 13/055 | 439/850 |
| 8,128,441 | B2 * | 3/2012 | Mukuno | H01R 13/055 | 439/845 |
| 8,152,576 | B2 * | 4/2012 | Nakamura | H01R 13/055 | 439/852 |
| 8,241,076 | B2 * | 8/2012 | Kubota | H01R 13/113 | 439/852 |
| 8,333,622 | B2 * | 12/2012 | Blasko | H01R 13/113 | 439/595 |
| 2008/0166901 | A1 | 7/2008 | Weber | | |
| 2009/0209143 | A1 | 8/2009 | Wu et al. | | |

OTHER PUBLICATIONS

PCT International Search Report, International Application No. PCT/IB2013/058153, dated Feb. 7, 2014, 11 pages.

* cited by examiner

ELECTRICAL CONNECTOR AND ELECTRICAL CONNECTOR ASSEMBLY

CROSS-REFERENCE TO RELATED APPLICATION

This application claims priority under 35 U.S.C. §119(a)-(d) to Chinese Patent Application No. 201220447084.X, filed on Sep. 4, 2012, and to International Patent Application No. PCT/IB2013/058153, filed on Aug. 30, 2013.

FIELD OF THE INVENTION

The invention is generally related to an electrical connector, and more specifically, to an electrical connector that transmits a high current.

BACKGROUND

Conventionally, electrical connector assemblies designed to transfer high levels of current are generally made of a precious metal like copper, where the metal has a large thickness. In addition, a costly metal, such as gold or silver, is plated on the precious metal to decrease a contact resistance and reduce temperature under the high current.

Chinese patent publication No. 1206509A discloses a conventional electrical connection terminal having a housing electrically connected to a conductive wire. The housing includes an inlet, an outlet, and a chamber positioned between the inlet and the outlet. At least three spring contacts are integrally formed on the housing at different positions and extend into the chamber. The spring contacts are elastically biased within the chamber. Thereby, when a mating electrical connection terminal is inserted into the electrical connection terminal through the inlet of the chamber, the spring contacts are deformed to allow the insertion of the mating electrical connection terminal into the chamber. After the mating electrical connection terminal is completely inserted into the chamber, the spring contacts exert a sufficient elastic force on the mating electrical connection terminal to hold the mating electrical connection terminal in the chamber, serving as electrical contacts within the chamber.

In the Chinese patent publication No. 1206509A, at least three spring contacts are used to achieve an electrical contact between the electrical connection terminal and the mating electrical connection terminal at a plurality of points. Accordingly, both the contact resistance and the temperature of the electrical connection terminals are reduced under high current.

However, the electrical connection terminal in Chinese patent publication No. 1206509A comprises at least three spring contacts, complicating the structure of the electrical connection terminal. In addition, it is difficult to ensure that all of the spring contacts remain stably in contact with the mating electrical connection terminal at the same time. Furthermore, the electrical connection terminal has poor heat dissipation characteristics.

There is a need for an electrical connector that can operate under high current conditions, that is relatively easy to manufacture, easy to ensure stable contact with a mating terminal, has a low operating temperature, and has good heat dissipation characteristics.

SUMMARY

An electrical connector assembly has a first connector and a second connector. The first connector has a first engagement portion on a first mating end, and at least one first ridge positioned on and protruding outward from an outer surface of the first engagement portion. The second connector has a second engagement portion on a second mating end. The second engagement portion has a first connector receiving chamber having an inner surface, and at least one second ridge positioned on and protruding inward from the inner surface. The at least one second ridge is positioned on, and protrudes inward from, the inner surface, being in electrical contact with the first ridge when the first engagement portion is positioned in the first connector receiving chamber.

BRIEF DESCRIPTION OF THE DRAWINGS

The invention will now be described by way of example, with reference to the accompanying Figures, of which.

DETAILED DESCRIPTION OF THE EMBODIMENT(S)

Figure 1:
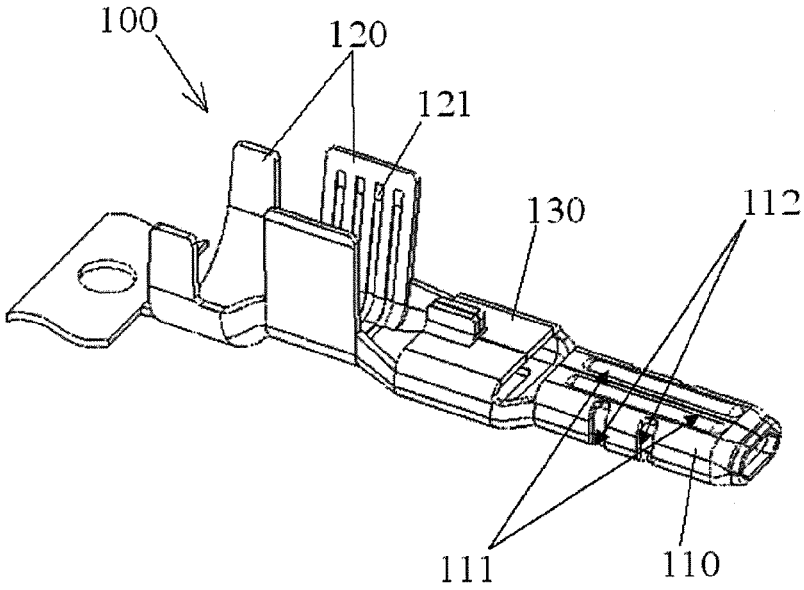
FIG. 1 is a perspective view of a first electrical connector.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiments set forth herein. Rather, these embodiments are provided so that the present disclosure will be thorough and complete, and will fully convey the concept of the disclosure to those skilled in the art.

As shown in the embodiments of FIGS. 1-4, an electrical connector assembly has a first connector 100 and a second connector 200.

Figure 2:
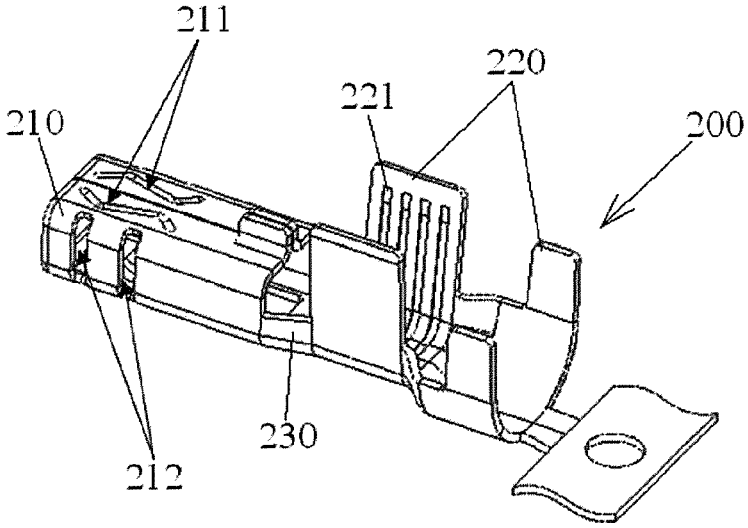
FIG. 2 is a perspective view of a second electrical connector.
Figure 3:
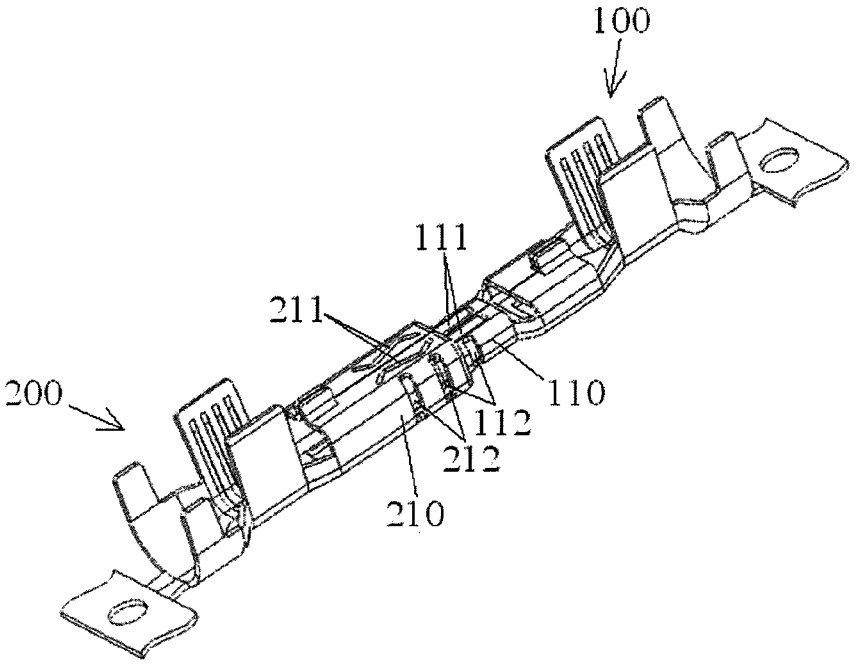
FIG. 3 is a perspective view of an electrical connector assembly having of the first connector and the second connector.

In the embodiments of FIGS. 1-3, the first connector 100 is a plug connector, and the second connector 200 is a receptacle connector to be mated with the first connector 100.

Referring to FIG. 1, the first connector 100 has a first engagement portion 110 at mating end, a first crimping portion 120 at an opposite terminating end, a first central body 130 connected to, and extending between, the first engagement portion 110 and the first crimping portion 120.

Referring to FIG. 2, the second connector 200 has a second engagement portion 210 at a mating end, a second crimping portion 220 at a terminating end, a second central body 230 connected to, and extending between, the second engagement portion 210 and the second crimping portion 220.

The first engagement portion 110 of the first connector 100 is adapted to be inserted into the second engagement portion 210 of the second connector 200 (See FIG. 3). The first crimping portion 120 of the first connector 100 is to be crimped on a first conductive wire (not shown) to electrically connect with the first conductive wire. The second crimping portion 220 of the second connector 200 is to be crimped on a second conductive wire (not shown) to electrically connect with the second conductive wire.

As shown in an embodiment of FIG. 1, at least one groove 121 is formed in the first crimping portions 120 to enhance a friction force between the first crimping portion 120 and the first conductive wire.

Similarly, as shown in an embodiment FIG. 2, at least one groove 221 is formed in the second crimping portions 220 to enhance a friction force between the second crimping portion 220 and the second conductive wire.

In an embodiment of FIG. 3, the first connector 100 and the second connector 200 are mated together, where the first connector 100 is inserted into the second connector 200. In an embodiment of FIG. 4, ridges 111, 211 positioned respectively on the first and second connectors 100, 200 are in contact with each other.

Figure 4:
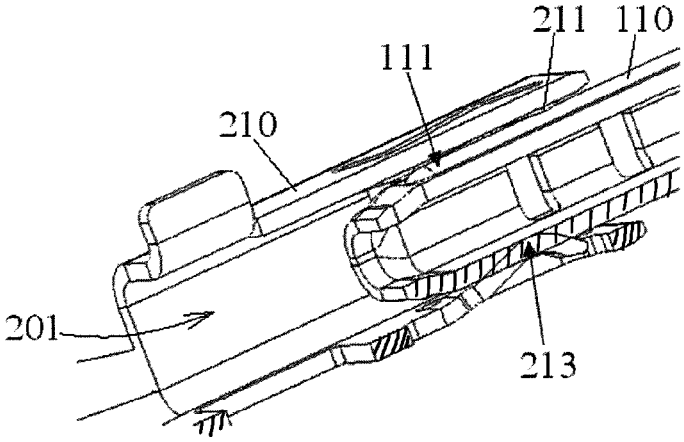
FIG. 4 is a local cross section view of the electrical connector assembly, showing ridges of the first and second connectors in contact.

As shown in the embodiments of FIGS. 3 and 4, the second engagement portion 210 of the second connector 200 has a first connector receiving chamber 201 into which the first engagement portion 110 of the first connector 100 is inserted to electrically contact the second engagement portion 210 of the second connector 200. In this way, the first connector 100 and the second connector 200 are electrically interconnected.

As shown in FIGS. 1-4, at least one first ridge 111 is positioned on and protruding outward from an outer surface of the first engagement portion 110. In an embodiment, the first ridge 111 extends a distance along a length of the first engagement portion 110. The first ridge 111 may be formed on a side wall of the first engagement portion 110 by pressing.

In the illustrated embodiments, a pair of first ridges 111 is positioned on the first engagement portion 110 of the first connector 100. In an embodiment, the pair of first ridges 111 extends a distance along the length of the first engagement portion 110 and each are substantially parallel to each other. But the present invention is not limited to two first ridges 111, in other embodiment, there may be one, three, or more first ridges on the first engagement portion 110 of the first connector 100.

As shown in an embodiment of FIG. 1, the first ridges 111 extend longitudinally in a straight line. The pair of first ridges 111 is parallel to each other and symmetrically positioned on the outer surface of the first engagement portion 110. However, the present invention is not limited to this, and in other embodiments, the first ridges 111 may extend in a curved line or a zigzag line. Furthermore, the first ridges 111 may be not parallel and symmetrical on the outer surface of the first engagement portion 110.

As shown in the embodiments of FIGS. 2 and 4, at least one second ridge 211 is positioned on and protrudes inwards from an inner surface of the first connector receiving chamber 201 of the second engagement portion 210. In an exemplary embodiment of the present invention, the second ridge 211 may be formed on a side wall of the second engagement portion 210 by pressing. In this case, when viewing from the outside of the second engagement portion 210, the second ridge 211 is recessed in an outer surface of the second engagement portion 210.

In the illustrated examples, a pair of second ridges 211 is formed on the inner surface of the second engagement portion 210. However, the present invention is not limited to this, and in other embodiments, there may be one, three or more second ridges on the second engagement portion 210 of the second connector 200.

In an embodiment of FIG. 2, the second ridges 211 extend longitudinally in a curved line or a zigzag line. The pair of second ridges 211 is symmetrically positioned on the inner surface of the first connector receiving chamber 201 of the second engagement portion 210. However, the present invention is not limited to this, and in other embodiments, the second ridges 211 may extend in a straight line or an arc line, and the second ridges 211 may be not symmetrical to each other.

In the embodiments of FIGS. 1 and 2, both the first and second ridges 111, 211 have a cross section of semicircle. However, the present invention is not limited to this, and in other embodiments, the first and second ridges 111, 211 may have a rectangular cross section.

In the embodiments of FIGS. 3 and 4, when the first engagement portion 110 is inserted into the first connector receiving chamber 201 of second engagement portion 210, the first ridges 111 electrically contact the second ridges 211, respectively.

Since the second ridges 211 extend in a curved line or a zigzag line and the first ridge 111 extends in a straight line, the first ridge 111 contacts the respective second ridge 211 at two or more points. As a result, the contact resistance is reduced, and an effective and stable electrical contact can be achieved. With the above simple structure, the electrical connector assembly of the present invention can carry a high current, such as 20 A or more.

In an embodiment (not shown), the first and second ridges 111, 211 may both extend in a curved line or a zigzag line as soon as they can electrically contact with each other at a plurality of points.

In an embodiment (not shown), the first ridge 111 may extend in a direction that is angled to a direction in which at least a part of the second ridge 211 extends. In this embodiment, the first and second ridges 111, 211 electrically contact with each other at a plurality of points.

In an embodiment of FIG. 1, at least one first ventilation hole 112 is formed in the first engagement portion 110 to dissipate a heat out of the first engagement portion 110.

In the illustrated embodiments, four first ventilation holes 112 are formed in the first engagement portion 110 and positioned on two opposite side surfaces of the first engagement portion 110. In an embodiment, the side surfaces are substantially perpendicular to the outer surface on which the ridge 111 is positioned. However, the present invention is not limited to this, and in other embodiments, there may be one, two, three, five or more first ventilation holes 112 in the first engagement portion 110.

In an embodiment of FIG. 2, at least one second ventilation hole 212 is formed in the second engagement portion 210 to dissipate a heat out of the second engagement portion 210.

In an embodiment, four second ventilation holes 212 are formed in the second engagement portion 210 and positioned on two opposite side surfaces of the second engagement portion 210. However, the present invention is not limited to this, and in other embodiments, there may be one, two, three, five or more second ventilation holes 212 in the second engagement portion 210.

Since ventilation holes 112, 212 are formed in the first and second engagement portions 110, 210, the heat generated by them can be rapidly dissipated out of the first and second connectors 100, 200 through the ventilation holes 112, 212. The heat dissipation is accomplished by accelerating air convection, thus preventing the temperature of the electrical connector assembly from reaching high temperatures during operation. For example, the temperature of the electrical connector assembly can be kept below 30° C. under a rated load current of 20 A.

The first and second connectors 100,200 may be made of a metal material, such as a copper-nickel-silicon alloy or a copper-iron alloy, or other suitable metals or alloys having a high thermal and electrical conductivity.

In an embodiment of FIG. 3, when the first engagement portion 110 is inserted into the second engagement portion 210, at least one of the first ventilation holes 112 is positioned proximate to at least one of the second ventilation holes 212, such that the holes 112,212 are in fluid communication to dissipate the heat out of the first and second engagement portions 110, 210. In this way, even if the first and second engagement portions 110, 210 are mated with each other, the heat generated inside them still can effectively be dissipated to the outside through the communicated ventilation holes 112, 212, thus increasing the effect of the heat dissipation.

In an embodiment of FIG. 4, at least one elastic arm 213 is positioned on the second engagement portion 210 and protrudes inwards from the inner surface of the first connector receiving chamber 201. When the first engagement portion 110 is inserted into the second engagement portion 210, the elastic arm 213 abuts against and electrically contacts an outer surface of a side of the first engagement portion 110 opposite to the first ridges 111, applying a force that pushes the first and second ridges 111,211 together. Thus the first and second ridges 111, 211 are stably kept in contacted with each other by the elastic deformation force of the elastic arm 213. In the embodiment of FIG. 4, only one elastic arm 213 is formed for simplifying the structure of the second engagement portion 210, however, as discussed above, one of ordinary skill in the art would appreciate that a plurality of elastic arms 213 may be used.

One of ordinary skill in the art would understand that the above description is intended to be illustrative, and not restrictive. For example, the above-described embodiments (and/or aspects thereof) may be used in combination with each other. In addition, many modifications may be made to adapt a particular situation or material according to the teachings of the invention without departing from the spirit and scope of the invention.

Although several exemplary embodiments have been shown and described, it would be appreciated by those of ordinary skill in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding pluralities of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. An electrical connector assembly, comprising:

a first connector having a first engagement portion on a first mating end, at least one first ridge positioned on and protruding outward from an outer surface of the first engagement portion, and at least one first heat dissipation ventilation hole positioned on the first engagement portion; and a second connector having a second engagement portion on a second mating end, the second engagement portion having a first connector receiving chamber having an inner surface, and at least one second ridge positioned on and protruding inward from the inner surface, being in electrical contact with the first ridge when the first engagement portion is positioned in the first connector receiving chamber.

2. The electrical connector assembly according to claim 1, wherein the at least one first ridge extends in a direction that is angled to a direction in which at least a part of the at least one second ridge extends.

3. The electrical connector assembly according to claim 1, wherein the at least one first ridge and the at least one second ridge each have a semicircular cross section.

4. The electrical connector assembly according to claim 3, wherein either the at least one first ridge or the at least one second ridge extends in a straight line, and the other of the at least one first ridge and the at least one second ridges extends in a curved line or a zigzag line.

5. The electrical connector assembly according to claim 3, wherein one first ridge electrically contacts a respective second ridge at a plurality of points.

6. The electrical connector assembly according to claim 5, wherein a pair of first ridges is symmetrically positioned on the outer surface of the first engagement portion.

7. The electrical connector assembly according to claim 6, wherein a pair of second ridges is symmetrically positioned on the inner surface of the first connector receiving chamber.

8. The electrical connector assembly according to claim 1, wherein at least one second heat dissipation ventilation hole is formed in the second engagement portion.

9. The electrical connector assembly according to claim 8, wherein when the first engagement portion is engaged with the second engagement portion, at least one of the first heat dissipation ventilation holes is positioned proximate to at least one of the second heat dissipation ventilation holes, such that there is fluid communication between the first and second heat dissipation ventilation holes.

10. The electrical connector assembly according to claim 9, wherein at least one elastic arm is formed on the second engagement portion.

11. The electrical connector assembly according to claim 10, wherein when the first engagement portion is engaged with the second engagement portion, the elastic arm abuts against and electrically contacts an outer surface of a side of the first engagement portion opposite to the first ridges.

12. The electrical connector assembly according to claim 1, wherein the first connector has a first crimping portion positioned on a first terminating end opposite the first mating end.

13. The electrical connector assembly according to claim 12, wherein the second connector has a second crimping portion positioned on a second terminating end opposite the second mating end.

14. The electrical connector assembly according to claim 12, wherein at least one groove is positioned on at least one of the first and second crimping portions to enhance a frictional force between each crimping portion and a respectively connected wire.

15. An electrical connector, comprising:

a metal engagement portion complementary to a mating electrical connector having at least one ridge, the engagement portion having an engaging surface, and at least one ridge positioned on and protruding from the engaging surface at the same height along the length of the engaging surface, the at least one ridge extending in a curved line or a zigzag line along the length of the engaging surface such that the at least one ridge electrically contacts the at least one ridge of the mating electrical connector at a plurality of points when the electrical connector is matched with the mating electrical connector.

* * * * *